United States Patent [19]

Hüttner et al.

[11] Patent Number: 5,004,363

[45] Date of Patent: Apr. 2, 1991

[54] APPLICATOR DEVICE FOR COSMETIC USES

[75] Inventors: Gerhard Hüttner, Geroldsgrün; Peter Krückel, Heroldsberg; Gerhard Möck, Kirchehrenbach, all of Fed. Rep. of Germany

[73] Assignee: Schwan-Stabilo Schwanhausser GmbH & Co., Nuremberg, Fed. Rep. of Germany

[21] Appl. No.: 491,861

[22] Filed: Mar. 12, 1990

[30] Foreign Application Priority Data

May 23, 1989 [DE] Fed. Rep. of Germany ..... 3916670

[51] Int. Cl.[5] ..... A45D 40/04

[52] U.S. Cl. ..... 401/75; 401/68

[58] Field of Search ..... 401/75, 174, 172, 173, 401/68, 73

[56] References Cited

U.S. PATENT DOCUMENTS

| | | | |
|---|---|---|---|
| 2,337,979 | 12/1943 | Dorner | 401/75 |
| 2,376,944 | 5/1945 | Songer | 222/390 |
| 3,256,980 | 6/1966 | Bau | 401/75 |

FOREIGN PATENT DOCUMENTS

| | | | |
|---|---|---|---|
| 3728427 | 12/1988 | Fed. Rep. of Germany | 401/75 |
| 1193220 | 3/1958 | France . | |
| 1351560 | 12/1963 | France | 401/75 |
| 956651 | 4/1964 | United Kingdom | 401/75 |

*Primary Examiner*—Richard J. Johnson

*Attorney, Agent, or Firm*—Bachman & LaPointe

[57] ABSTRACT

An applicator device for cosmetic purposes which is intended in particular for trying out or selecting a suitable cosmetic stick or color shade thereof comprises a casing in the form of a tubular element accommodating a stick of cosmetic material having an application portion which projects from the casing. At its rear end portion remote from the application portion of the stick the tubular element internally provides a holding portion into which an externally screwthreaded portion of a forward feed spindle can be screwed. The spindle bears with the forward end against the inwardly disposed end of the stick while the rearward end of the spindle carries an actuating member which projects from the rear end of the tubular element for actuation of the spindle.

5 Claims, 1 Drawing Sheet

APPLICATOR DEVICE FOR COSMETIC USES

BACKGROUND OF THE INVENTION

A typical applicator device for a cosmetic use is for example of a pencil-like form, as for applying eye shadow, lipstick or the like, with the cosmetic material being in the form of a pasty stick. However, before actually purchasing an applicator device of that kind, a prospective purchaser may often wish to try out the applicator device, for example in order to choose a suitable color shade of cosmetic material. In view of the very wide range of different color shades which are generally offered in such applicator devices, it will be apparent that a large number of samples must be available to the public in order for potential purchasers to be able to try out cosmetics of different colors, in order to select the desired color. In the case of an applicator device of the usual size, that would involve a not inconsiderable amount of storage space for the sample devices, to cover the entire range of different colors and cosmetic materials.

SUMMARY OF THE INVENTION

An object of the present invention is to provide an applicator device for cosmetic uses, which is of a simple design configuration and easy to handle, more specifically for testing and sample purposes.

Another object of the present invention is to provide an applicator device for cosmetic uses which is easy to handle and of a compact construction while affording a considerable amount of cosmetic material for the purposes of testing an sampling the cosmetic material.

A further object of the present invention is to provide an applicator device for cosmetic uses, which is of a compact size lending itself to use as a sample device, while enabling almost all the cosmetic material stick therein to be utilised for testing and sampling purposes.

In accordance with the principles of the present invention, those and other objects are achieved by an applicator device for cosmetic uses comprising an elongate casing including a tubular element having a front end and a rear end, and being of an axial lengthwise extent substantially of between 20 and 60 mm and an outside diameter substantially of between 3 and 8 mm. The device includes a pasty stick of cosmetic material, of an axial lengthwise dimension substantially of between 5 and 20 mm and a diameter substantially of between 2 and 5 mm. The stick is disposed in the casing at the front end thereof and provides an application portion which projects out of the front end of the casing. The device further includes a forward feed spindle having a forward end co-operating with the end of the stick which is inward of the casing, and a rearward end which projects out of the casing, and also comprising an external screwthread means on the spindle at a spacing from said forward end of the spindle, towards the rearward end thereof. The casing provides means for guiding the spindle in the front end portion of the casing and the casing, in a rear end portion thereof, internally comprises a holding portion for said external screwthread means on the spindle. An actuating member is disposed on the rearward end of the spindle, which projects out of the casing. A closure cap is adapted to be fitted on to the casing to protect the application portion of the stick, which projects from the casing.

As will be seen in greater detail from the description of preferred embodiments hereinafter, the actuating member on the rearward end of the spindle can be rotated about the longitudinal axis of the applicator device, thereby to cause the spindle to be moved forwardly as desired within the applicator device so that at the same time the stick against which the forward end of the spindle bears can be extended from the casing of the applicator device. In that way the stick can be progressively caused to project from the casing as it is gradually worn down by use of the applicator device, so that it is possible for the stick to be virtually entirely utilised. The stick of the applicator device according to the invention, which can be used more particularly for testing and sampling purposes, may be an extruded stick of cosmetic material which is fitted into the tubular element of the casing, but it is also possible for a stick to be formed in the tubular element by casting thereof. It will be seen that, by virtue of the provision of the internal holding portion at the rear end portion of the tubular element of the casing, and the external screwthread means on the spindle which co-operates with the holding portion, and by virtue of the means guiding the forward end portion of the spindle in the front end portion of the tubular element of the casing, the spindle is suitably guided in the casing at two axially spaced-apart locations, whereby the spindle is easy to operate. In the simple construction of the applicator device according to the invention, the feed spindle simply bears against the inwardly disposed end of the stick so that the spindle can be actuated only to push the stick forwardly out of the casing of the device. It is not possible for the spindle to be operated in order to retract the stick into the casing of the device directly, but such retraction movement of the stick is also generally not required as the applicator device in accordance with the present invention is only intended for testing and sampling purposes. However, its simplicity of design means that the applicator device according to the invention can be manufactured inexpensively, and that is a crucial consideration in regard to the intended purpose of use of the applicator device.

The actuating member which projects from the casing at the rear end thereof may be in the form of a cylindrical or polygonal rotary knob which may be provided with a suitable knurling or milling thereon.

In accordance with a preferred feature of the invention the holding portion at the rear end portion of the tubular element of the casing can be in the form of an internally screwthreaded portion. In that case the internally screwthreaded portion corresponds in regard to screwthread diameter and screwthread pitch to the external screwthread on the spindle. In a simpler configuration of the applicator device however the holding portioin at the rear end portion of the tubular element of the casing is in the form of a peripherally extending shoulder or collar portion on the inside of the tubular element, which reduces the internal cross-section thereof. Such a tubular element with the shoulder or collar portion on its inward side can be produced with a simpler and less expensive molding tool than a tubular element which is provided with an internally screwthreaded portion as referred to above.

It is also possible however for the holding portion at the rear end portion of the tubular element of the casing to be formed by ribs provided on the inside of the tubular element and extending in the axial direction thereof. In the case of the applicator device configuration with the shoulder or collar portion on the inside thereof, or with the ribs extending on the inside of the casing in the axial direction thereof, the spindle with its external screwthread means is simply fitted into the tubular element from the rear end thereof and screwed thereinto, with the external screwthread means on the spindle cutting into the shoulder or collar portion or into the ribs respectively. For that purpose it has been found advantageous for the spindle with its external screwthread means to comprise a harder plastic material than the tubular element with its internal holding portion. In that way it is possible for the spindle or the external screwthread means thereon to cut or form a suitable internal screwthread in the holding portion when the spindle is screwed into the casing.

In order for the central internal space in the tubular element and therewith the stick disposed therein to be hermetically sealed off from the rear end of the applicator device, a preferred feature of the invention provides that the outside diameter of the external screwthread means on the spindle corresponds to the inside diameter of the tubular element, and the core diameter of the portion providing the external screwthread means on the spindle corresponds to the internal cross-sectional dimensions of the holding portion. That arrangement, in addition to the sealing effect, also provides mutually corresponding self-cut or self-formed screwthread configurations.

Further objects, features and advantages of the present invention will be apparent from the following description of preferred embodiments thereof.

DESCRIPTION OF PREFERRED EMBODIMENTS

Figures 1, 2, 3, 4, 5, 6, 7, 8, 9, 10, 11, 12:
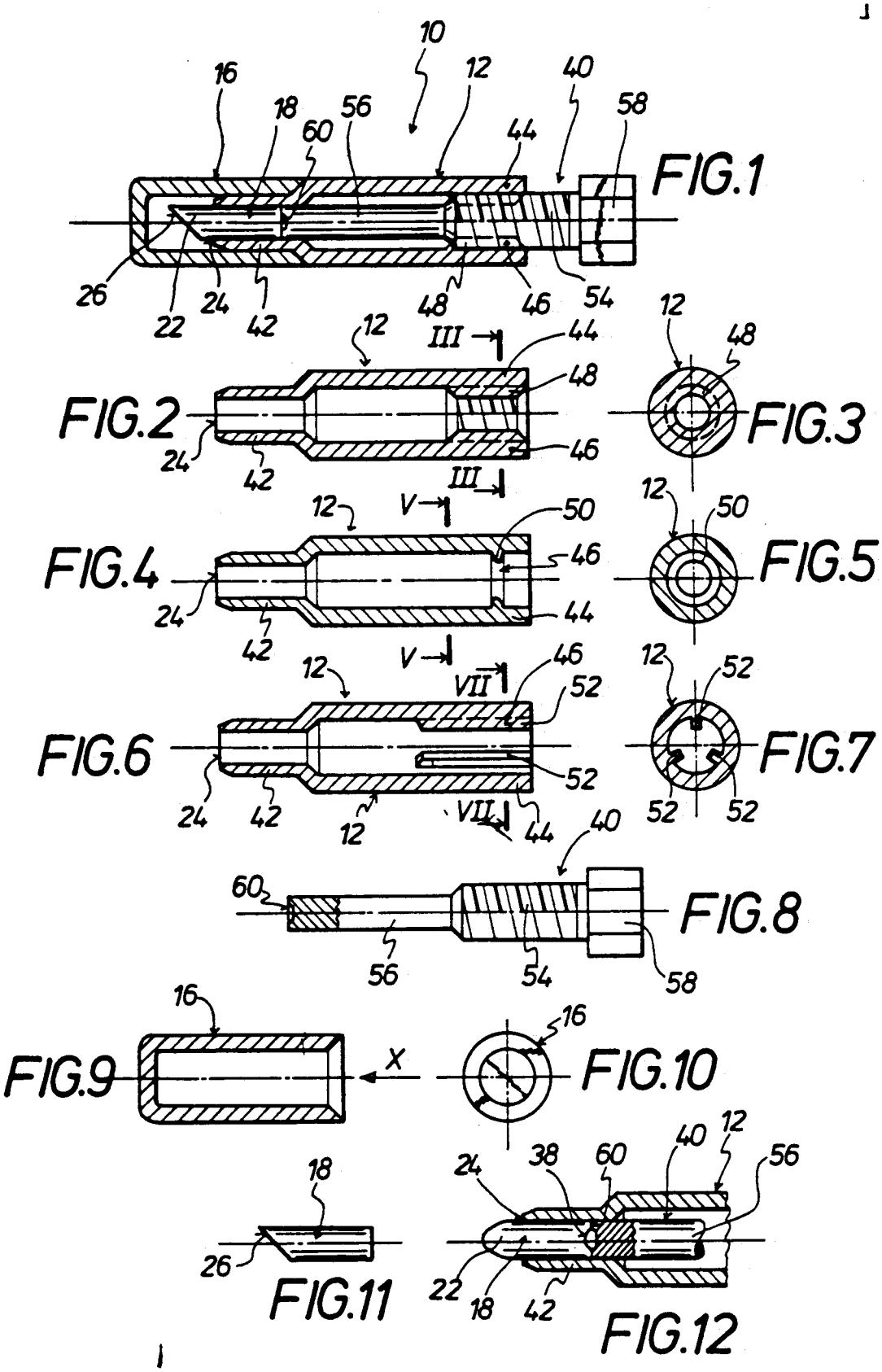
FIG. 1 is a view in longitudinal section through a first embodiment of an applicator device according to the invention.
FIG. 2 is a view in longitudinal section through the tubular element of the applicator device shown in FIG. 1.
FIG. 3 is a view in section taken along line III—III in FIG. 2.
FIG. 4 is a view in longitudinal section through a second embodiment of the tubular element.
FIG. 5 is a view in section taken along line V—V in FIG. 4.
FIG. 6 is a view in longitudinal section through a third embodiment of the tubular element.
FIG. 7 is a view in section taken along line VII—VII in FIG. 6.
FIG. 8 is a side view of the feed spindle of the applicator device shown in FIG. 1.
FIG. 9 is a view in longitudinal section through a closure cap of the applicator device shown in FIG. 1.
FIG. 10 is a view of the closure cap looking in the direction indicated by the arrow X—X in FIG. 9.
FIG. 11 is a side view of the stick of the applicator device shown in FIG. 1.
FIG. 12 shows a front end portion of a configuration of the applicator device with a stick cast therein.

Referring firstly to FIG. 1 shown therein on an enlarged scale is an applicator device 10 according to the invention, comprising a tubular casing or tubular element 12 with a closure cap 16 which is adapted to be fitted thereon, a stick 18 of pasty cosmetic material and a forward feed spindle 40. The tubular element 12 has a front end portion 42 which is of an inside diameter which corresponds to the diameter of the stick 18. FIG. 1 shows a stick 18 comprising an extruded material, the stick 18 having an application portion 22 which projects beyond the front end 24 or the front end portion 42 of the tubular element 12. The stick 18 has a bevelled front end surface 26.

The closure cap 16 is of an inside diameter which corresponds to the outside diameter of the front end portion 42 of the tubular element 12. As a result, a hermetic seal is formed in respect of the stick 18 between the closure cap 16 and the front end portion 42 of the tubular element 12, in the condition of the closure cap 16 in which it is fitted on to the tubular element 12, as shown in FIG. 1.

At its rear end portion 44 which is remote from the front end portion 42, the tubular element 12 is internally provided with a holding portion which is generally indicated at 46 and which is provided for example in the form of an internally screwthreaded portion 48, as shown in FIGS. 1 through 3, in the form of a peripherally extending internal shoulder portion as indicated at 50 in FIGS. 4 and 58 or in the form of ribs 52 as shown in FIGS. 6 and 7. The ribs 52 preferably extend in the axial direction of the tubular element 12 and are preferably arranged in a uniformly distributed array in the peripheral direction of the tubular element 12.

The tubular element 12 preferably comprises a softer plastic material than the feed spindle 40 which is provided with an externally screwthreaded portion as indicated at 54 in FIGS. 1 and 8. The fact that the feed spindle 40 or the externally screwthreaded portion 54 thereof comprises a harder material than the tubular element 12 means that it is possible for an internal screwthread configuration corresponding to the screwthread on the externally screwthreaded portion 54 of the spindle 40 to be cut through the shoulder portion 50 in the tubular element 12 shown in FIGS. 4 and 5 or into the ribs 52 in the tubular element 12 shown in FIGS. 6 and 7, when the spindle 40 is turned or screwed into the tubular element 12 from the rear end portion 44 thereof.

At its front end the spindle 40 has a spindle portion 56, as indicated in FIGS. 1 and 8, which is of a diameter corresponding to the internal diameter of the front end portion 42 of the tubular element 12. As a result, that configuration provides a guiding action both between the spindle portion 56 and the front end portion 42 of the tubular element 12, and also be means of the externally screwthreaded portion 54 on the spindle 40 and the holding portion 46 in the tubular element 12 so that the spindle 40 can be actuated without serious problems, that is to say it can be readily screwed into the tubular element 12.

For the purposes of actuation of the spindle 40, the spindle 40 is provided with an actuating member 58 on its rearward end portion where it projects out of the rear end of the tubular element 12. The actuating member 58 can be of any suitable configuration, for example as illustrated, in the form of a hexagonal bolthead-like member, or cylindrical, for example with a knurled or milled peripheral surface, or the like.

It will be appreciated that the Figures of the accompanying drawings identify the same components with the same reference numerals in each case so that there is no need for all such details to be described in full detail in relation to each of the individual Figures of the drawings.

Reference will now be made to FIG. 11 showing a side view of an extruded stick 18 as may be employed in the applicator device 10 shown for example in FIG. 1. In comparison therewith, FIG. 12 shows a stick 18 with a rounded application portion 22, with the stick 18 being cast into the front end portion 42 of the tubular element 12 of which only part is shown in FIG. 12. FIG. 12 also only shows part of the spindle 40, more specifically part of the forward portion 56 thereof. The fact that the stick 18 illustrated in FIG. 12 is a cast stick is indicated by the concavely curved end face indicated at 38 on the stick 18, against which the forwared end face 60 of the forward end portion 56 of the spindle 40 bears, that front end face 60 on the spindle 40 also being shown separately in FIG. 8.

It will be noted that the outside diameter of the externally screwthreaded portion 54 of the spindle 40 at least substantially corresponds to the inside diameter of the tubular element 12, while the diameter of the core or shank portion of the externally screwthreaded portion 54 of the spindle 40 corresponds to the internal cross-sectional dimensioning of the holding portion 46 inside the tubular element 12.

The tubular element of the casing has an axial lengthwise extent substantially of between 20 and 60 mm and an outside diameter substantially of between 3 and 8 mm, while the stick 18 is of an axial lengthwise dimension substantially of between 5 mm and 20 mm and a diameter substantially of between 2 and 5 mm. In a preferred construction the axial length of the casing is substantially 40 mm and its outside diameter is substantially 5 mm, and the axial length of the stick 18 is substantially 10 mm and its diameter is substantially 3 mm.

It will be further appreciated that the above-described constructions have been set forth solely by way of example and illustration of th principles of the present invention and that various modifications and alterations may be made therein without thereby departing from the spirit and scope of the present invention.

We claim:

1. An applicator device for cosmetic uses comprising: an elongate plastic casing having a front end and a rear end and including a tubular element of an axial lengthwise extent substantially of between 20 and 60 mm and an outside diameter substantially of between 3 and 8 mm; a pasty stick of cosmetic material, of an axial lengthwise dimension substantially of between 5 and 20 mm and a diameter substantially of between 2 and 5 mm, the stick being disposed in the tubular element of the casing at the front end thereof and providing an application portion adapted to project out of the front end of the casing; a plastic feed spindle having a forward end which bears against the end of the stick which is inward of the casing and a rearward larger diameter end which projects out of the casing, the spindle comprising an external screwthread means at a spacing from said forward end of said spindle towards said rearward end thereof; means guiding the spindle in the front end portion of the casing; the casing in a rear end portion therof internally comprising an integrally formed holding portion having a threaded portion engaged with said external screwthreaded means on said spindle; an actuating member on the rearward end portion of the spindle which projects out of said tubular element; and a closure cap adapted to fit on to the front end of the casing wherein the spindle with its external screwthread means comprises a harder plastic material than the tubular element with its holding portion.

2. An applciator device as set forth in claim 1 wherein said holding portion at the rearward end portion of the tubular element is in the form of an internally screwthreaded portion.

3. An applicator device as set forth in claim 1 wherein the holding portion at the rear end portion of the tubular element in in the form of a shoulder which extends around the tubular element on the interior thereof and reduces the internal cross-section thereof.

4. An applicator device as set forth in claim 1 wherein the outside diameter of the externally screwthreaded portion of the spindle corresponds to the inside diameter of the tubular element and the core diameter of the externally screwthreaded portion of the spindle corresponds to the internal cross-sectional dimension of said holding portion.

5. An applicator device as set forth in claim 1 wherein said holding portion at the rear end portion of the tubular element is formed by ribs on the inside of the tubular element extending in the axial direction thereof.

* * * * *